US005456848A

United States Patent [19]

Nader et al.

[11] Patent Number: 5,456,848

[45] Date of Patent: Oct. 10, 1995

[54] HIGH TEMPERATURE LUBRICANTS CONTAINING CESIUM, ROBIDIUM, AND LITHIUM SALTS

[75] Inventors: Bassam S. Nader; Ted A. Morgan, both of Midland, Mich.

[73] Assignee: The United States of America as represented by the Secretary of the Air Force, Washington, D.C.

[21] Appl. No.: 5,700

[22] Filed: Jan. 19, 1993

[51] Int. Cl.[6] ..... C10M 113/16

[52] U.S. Cl. ..... 252/25; 252/41; 252/400.62

[58] Field of Search ..... 252/18, 25, 400.62, 252/41, 42, 397

[56] References Cited

U.S. PATENT DOCUMENTS

| | | | |
|---|---|---|---|
| 3,213,025 | 10/1965 | Hedenburg | 252/42 |
| 3,405,072 | 10/1968 | Kinnavy | 252/400.62 |
| 3,492,229 | 1/1970 | Weiss | 252/42 |
| 3,674,822 | 7/1972 | Stemnisky | 260/429.7 |

OTHER PUBLICATIONS

John Stemnisky et al., "Antixoidants for High–Temperature Lubricants," *ASLE Transactions,* 1964, vol. 7, pp. 43–54.

Harold Ravner et al., "Antioxidant Action of Metals and Metal–Organic Salts in Fluoroesters and Polyphenyl Ethers," *Journal of Chemical and Engineering Data,* vol. 8, No. 4, Oct. 1963, pp. 591–596.

H. Ravner et al., "High–Temperature Stabilization of Polyphenyl Ethers by Soluble Metal–Organic Salts," *ASLE Transactions,* 1975, vol. 18, pp. 1–4.

H. Ravner et al., "High–Temperature Stabilization of Polyphenyl Ethers By Inorganic Salts," *ASLE Transactions,* 1972, vol 15, pp. 45–53.

*Primary Examiner*—Peter A. Nelson

*Attorney, Agent, or Firm*—Charles E. Bricker; Thomas L. Kundert

[57] ABSTRACT

In one respect, this invention is a lubricating composition which comprises a polyaryl ether lubricating fluid and an additive which is (a) cesium carbonate, (b) cesium phosphate, or (c) a benzoate of cesium, rubidium, or lithium wherein the additive is present in the lubricating composition in an amount effective to produce an antioxidative effect in the lubricating composition. In another respect, this invention is a process for reducing the rate of oxidation in a polyaryl ether lubricating fluid which comprises adding an additive wherein the additive is (a) cesium carbonate, (b) cesium phosphate, or (c) a benzoate of cesium, rubidium, or lithium to the polyaryl ether lubricating fluid in an amount effective to produce an antioxidative effect in the lubricating composition.

14 Claims, No Drawings

HIGH TEMPERATURE LUBRICANTS CONTAINING CESIUM, ROBIDIUM, AND LITHIUM SALTS

The U.S. Government has a paid-up license in this invention and the right in limited circumstances to require the patent owner to license others on reasonable terms as provided by the terms of Contract No. F33615-89-C-2918 awarded by the U.S. Air Force.

BACKGROUND OF THE INVENTION

This invention relates to polyaryl ether, high temperature lubricants which contain antioxidants.

There are only a few classes of compounds that qualify as high temperature fluids, that is, fluids used at temperatures above 300° C. A well known class of such fluids are the polyaryl ethers. While generally stable, these lubricants can undergo oxidation at very high temperatures which leads to increased viscosity and shortened useful working life of the fluid. Therefore, it is desirable to find new and effective additives that serve as antioxidants for high temperature lubricants. Ravner et al. have reported the addition of various inorganic salts in polyphenyl ethers as antioxidants in *ASLE Transactions,* volume 15, pages 45–53 (1972) and in *ASLE Transactions,* volume 18, pages 1–4 (1975). However, the inorganic salts disclosed therein do not perform as well as is desirable.

SUMMARY OF THE INVENTION

This invention, in one respect, is a lubricating composition which comprises a polyaryl ether lubricating fluid and an additive wherein the additive is (a) cesium carbonate, (b) cesium phosphate, or (c) a benzoate of cesium, rubidium, or lithium and wherein the additive is present in the lubricating composition in an amount effective to produce an antioxidative effect in the lubricating composition.

In another respect, this invention is a process for reducing the rate of oxidation in a polyaryl ether lubricating fluid which comprises adding an additive wherein the additive is (a) cesium carbonate, (b) cesium phosphate, or (c) a benzoate of cesium, rubidium, or lithium to the polyaryl ether lubricating fluid in an amount effective to produce an antioxidative effect in the lubricating composition.

DETAILED DESCRIPTION OF THE INVENTION

The antioxidant additives of this invention are cesium, rubidium, and lithium salts which are composed of the metal cation and an anion. Suitable cesium salts include those wherein the anion is carbonate, phosphate, or benzoate, preferably, the anion is carbonate or benzoate; more preferably, the anion is benzoate. Suitable rubidium salts include those wherein the anion is benzoate. Suitable lithium salts include those wherein the anion is benzoate.

The carbonate and phosphate salts useful in this invention are well known materials and are readily available commercially.

Suitable benzoates useful as anions in this invention include benzoate and substituted benzoates. When the benzoate is substituted, suitable substitutes include phenoxy, phenyl, trifluoromethyl, trifluoromethylphenoxy, trifluoromethoxy, trifluormethoxyphenoxy, and trifluoromethoxyphenyl. Substituted benzoate for purposes of this invention includes naphthoates. When the lubricating fluid contains fluorine, it is preferred to employ a phenoxy which also contains fluorine. Preferred substituted benzoates include 2-phenoxybenzoate, 3-phenoxybenzoate, 4-phenoxybenzoate, 2-phenylbenzoate, 3-phenylbenzoate, 4-phenylbenzoate, 1-naphthoate, 2-naphthoate, 2-(trifluoromethyl )benzoate, 3-(trifluoromethyl)-benzoate, 4-(trifluoromethyl)benzoate, 2-(3-trifluoro-methyl)phenoxybenzoate, 3-(3-trifluoromethyl)-phenoxybenzoate, 4-(3-trifluoromethyl)phenoxybenzoate, 2-(trifluoromethyl )benzoate, 3-(trifluoromethyl)-benzoate, 4-(trifluoromethyl-)benzoate, 2-(trifluormethoxy)benzoate, 3-(trifluoromethoxy)benzoate, 4-(trifluoromethoxy)benzoate, 2-(3-trifluoromethoxy)-phenoxybenzoate, 3-(3-trifluoromethoxy)phenoxybenzoate, and 4-(3-trifluoromethoxy)phenoxybenzoate.

The cesium, rubidium, and lithium benzoates are generally prepared by reacting the metal hydroxide with a corresponding benzoic acid to form a resulting organometallic salt. This reaction can be readily performed in neutral to basic aqueous media in the temperature range from about 0° C. to about 100° C. The reaction can be stirred. The salts are recovered and purified, if purification is necessary, by conventional methods. The various benzoic acids can be prepared by well know methods.

The cesium, rubidium, and lithium salts of this invention are used as antioxidant additives for lubricating fluids in a lubricant composition. Suitable lubricating fluids include polyaryl ether fluids, preferably polyphenyl ethers. Representative examples of polyaryl ethers include para and meta forms of bis(phenoxy-phenoxy) benzene (known as "5P4E"), para and meta forms of bis(phenoxyphenyl) ether (known as "4P3E"), and para and meta forms of phenoxyphenoxy benzene (known as "3P2E").

The cesium, rubidium, and lithium salts are employed in the lubricant composition in any amount sufficient to produce an antioxidant effect in the lubricating fluid. Preferably, the cesium, rubidium, and lithium salts are employed in a concentration, based on the weight of the lubricating fluid in the composition, of greater than or equal to about 0.1 percent, more preferably greater than or equal to about 0.5 percent, and most preferably greater than or equal to about 1 percent; and preferably less than or equal to about 20 percent, more preferably less than or equal to about 10 percent, and most preferably less than or equal to about 5 percent. The additive can be added to the lubricating fluid at any time prior to use or during use.

The lubricating composition of this invention can contain additional components such as corrosion inhibitors, additional antioxidants, and anti-wear additives.

The following examples are given to illustrate the invention and should not be interpreted as limiting the invention in any way. Unless stated otherwise, all parts and percentages are given by weight.

EXAMPLE

Evaluation of Several Additives

Formulations of commercial polyphenyl ether (5P4E) and cesium salts were prepared by adding 0.1 percent of the cesium salt to 5P4E, followed by mixing and heating at 150° C. for about 2 hours. The admixed formulations were subjected to bulk oxidation stability evaluation at 330° C. using the Micro-Corrosion and Oxidation Stability (Micro-COS) test method for 24 hours in the presence of six metal coupons of Ti, INCO, M50 steel, Cr-M50 steel, Ag, and Al.

During the test, air was bubbled through the formulation with a flow rate of 1 liter per hour. The percent change in viscosity was then determined. The results are reported below in Table I. In the Table, "ΔViscosity 40° C." and "Δ Viscosity 100° C." denote the differences in viscosity of the formulations after the evaluation at temperatures of 40° C. and 100° C. respectively. In the Table, "ΔTAN" indicates the change in total acid number of the formulation after the evaluation. Also in the Table, "Cs(Benz)" cesium benzoate.

TABLE I

| Additive | Δ Viscosity 40° C. | Δ Viscosity 100° C. | Δ TAN |
|---|---|---|---|
| None① | 133.9 | 46.7 | 0.22 |
| $Cs_3PO_4$ | 14.8 | 5.9 | 0.04 |
| $Cs_2CO_3$ | 8.7 | 2.5 | 0.00 |
| Cs(Benz) | 8.4 | 0.7 | 0.05 |

①Not an embodiment of the invention.

The data in Table I shows that the viscosity of the formulation shows less change in viscosity as compared to a formulation containing no additive. Since the formulations were subjected to oxidative conditions during the evaluation, the data shows that the cesium salts tested function as antioxidants since the formulations containing cesium salts display less breakdown of the 5P4E fluid relative to untreated 5P4E. Breakdown of fluid leads to an increase in viscosity. Similarly, the formulations containing additive show less of an increase in acids as indicated by the change in total acid number relative to the formulation containing no additive.

COMPARATIVE EXPERIMENT (Not an embodiment of the invention)

The procedure of the Example was repeated using barium phosphate ($Ba_3(PO_4)_2$)and barium carbonate ($BaCO_3$) as the additive. The results are shown in Table II.

TABLE II

| Additive | Δ Viscosity 40° C. | Δ Viscosity 100° C. | Δ TAN |
|---|---|---|---|
| $Ba_3(PO_4)_2$ | 309.6 | 97.0 | 0.37 |
| $BaCO_3$ | 61.4 | 21.4 | 0.00 |

As seen in Table II, barium phosphate and barium carbonate are far less effective as antioxidants as opposed to the phosphate and carbonate of cesium tested in the Example. Whereas cesium phosphate and cesium carbonate both significantly reduce the amount of viscosity increase in the polyphenyl ether fluid relative to a fluid containing no additive, barium phosphate increases viscosity relative to fluid containing no additive and the effect of barium carbonate is relatively small as compared to the effect of cesium carbonate in Example 1. It is seen, therefore, that cesium phosphate and cesium carbonate are far superior antioxidants over barium phosphate and barium carbonate.

What is claimed is:

1. A lubricating composition which comprises a polyaryl ether lubricating fluid and an additive wherein the additive is (a) cesium carbonate, (b) cesium phosphate, or (c) an unsubstituted benzoate of cesium, rubidium, or lithium and wherein the additive is present in the lubricating composition in an amount effective to produce an antioxidative effect in the lubricating composition.

2. The lubricating composition of claim 1 wherein the additive is present in an amount between about 0.1 percent and about 10 percent based on the weight of the polyaryl ether lubricating fluid.

3. The lubricating composition of claim 2 wherein the additive is a cesium benzoate, cesium carbonate, or cesium phosphate.

4. The lubricating composition of claim 2 wherein the additive is a cesium benzoate.

5. The lubricating composition of claim 2 wherein the additive is a lithium benzoate.

6. The lubricating composition of claim 2 wherein the additive is a rubidium benzoate.

7. The lubricating composition of claim 1 wherein the additive is present in an amount between about 0.5 percent and about 5 percent based on the weight of the polyaryl ether lubricating fluid.

8. A lubricating composition which comprises a polyaryl ether lubricating fluid and an additive wherein the additive is (a) cesium carbonate, (b) cesium phosphate, or (c) an unsubstituted benzoate of cesium, rubidium, or lithium and wherein the additive is present in an amount between about 0.5 percent and about 5 percent based on the weight of the polyaryl ether lubricating fluid.

9. A process for reducing the rate of oxidation in an polyaryl ether lubricating fluid which comprises adding an additive wherein the additive is (a) cesium carbonate, (b) cesium phosphate, or (c) an unsubstituted benzoate of cesium, rubidium, or lithium to the polyaryl ether lubricating fluid in an amount between about 0.1 percent and about 10 percent based on the weight of the polyaryl ether lubricating fluid.

10. The process of claim 9 wherein the additive is a cesium benzoate, cesium carbonate, or cesium phosphate.

11. The process of claim 9 wherein the additive is a cesium benzoate.

12. The process of claim 9 wherein the additive is a lithium benzoate.

13. The process of claim 9 wherein the additive is a rubidium benzoate.

14. The process of claim 9 wherein the additive is present in an amount between about 0.5 percent and about 5 percent based on the weight of the polyaryl ether lubricating fluid.

* * * * *